US005336323A

United States Patent [19]

Cotton et al.

[11] Patent Number: 5,336,323

[45] Date of Patent: Aug. 9, 1994

[54] APPARATUS FOR PREPARING WALLPAPER FOR APPLICATION

[75] Inventors: David Cotton, Gadsden; Adelbert H. Richards, III; James E. Harris, both of Birmingham, all of Ala.

[73] Assignee: Paper Draper, Inc., Birmingham, Ala.

[21] Appl. No.: 894,589

[22] Filed: Jun. 5, 1992

[51] Int. Cl.[5] ..... B05C 3/02

[52] U.S. Cl. ..... 118/428; 118/DIG. 17; 118/39

[58] Field of Search ..... 118/419, 428, DIG. 17, 118/40, 423, 37, 38, 39

[56] References Cited

U.S. PATENT DOCUMENTS

| | | | |
|---|---|---|---|
| 305,774 | 9/1884 | Young | 118/39 |
| 657,466 | 9/1900 | Taber | 118/38 |
| 836,714 | 0/1906 | Shirk . | |
| 1,974,734 | 0/1934 | Barker . | |
| 1,998,394 | 4/1935 | Golder | 118/38 |
| 2,472,935 | 6/1949 | Boivin | 118/38 |
| 2,614,521 | 10/1952 | Eida | 118/39 |
| 4,300,471 | 0/1981 | Desjardins | 118/235 |
| 4,377,983 | 0/1983 | Skarsten | 118/42 |
| 4,554,886 | 11/1985 | Carter | 118/DIG. 17 |
| 4,582,019 | 4/1986 | Barschneider | 118/246 |
| 4,934,311 | 6/1990 | Topelko | 118/428 |
| 5,040,483 | 8/1991 | Liebermann | 118/428 |
| 5,134,966 | 8/1992 | Allen | 118/428 |

*Primary Examiner*—W. Gary Jones
*Assistant Examiner*—Brenda A. Lamb
*Attorney, Agent, or Firm*—Veal & Associates

[57] ABSTRACT

Wallpaper dispenser for automatically hydrating a film of glue pre-applied to one side of a roll of wallpaper. The dispenser includes a reservoir having a roll of wallpaper rotatably supported thereover and a roller for guiding the wallpaper within a quantity of water contained within the reservoir. A ramp is provided for cutting the wallpaper and includes a cutting ridge along which a cutting member is drawn to cut the wallpaper perpendicular to the length thereof. A tape measure and means for securing the tape measure adjacent the ridge are provided to indicate the point, forwardly of the ridge, adjacent which the forward margin of the wallpaper should be positioned. A slidable member is provided to automatically align the pattern on one strip of wallpaper with the same pattern on a previously cut strip when the strips are positioned in laterally adjacent relation and with the top margins thereof in alignment.

8 Claims, 9 Drawing Sheets

FIG. 14
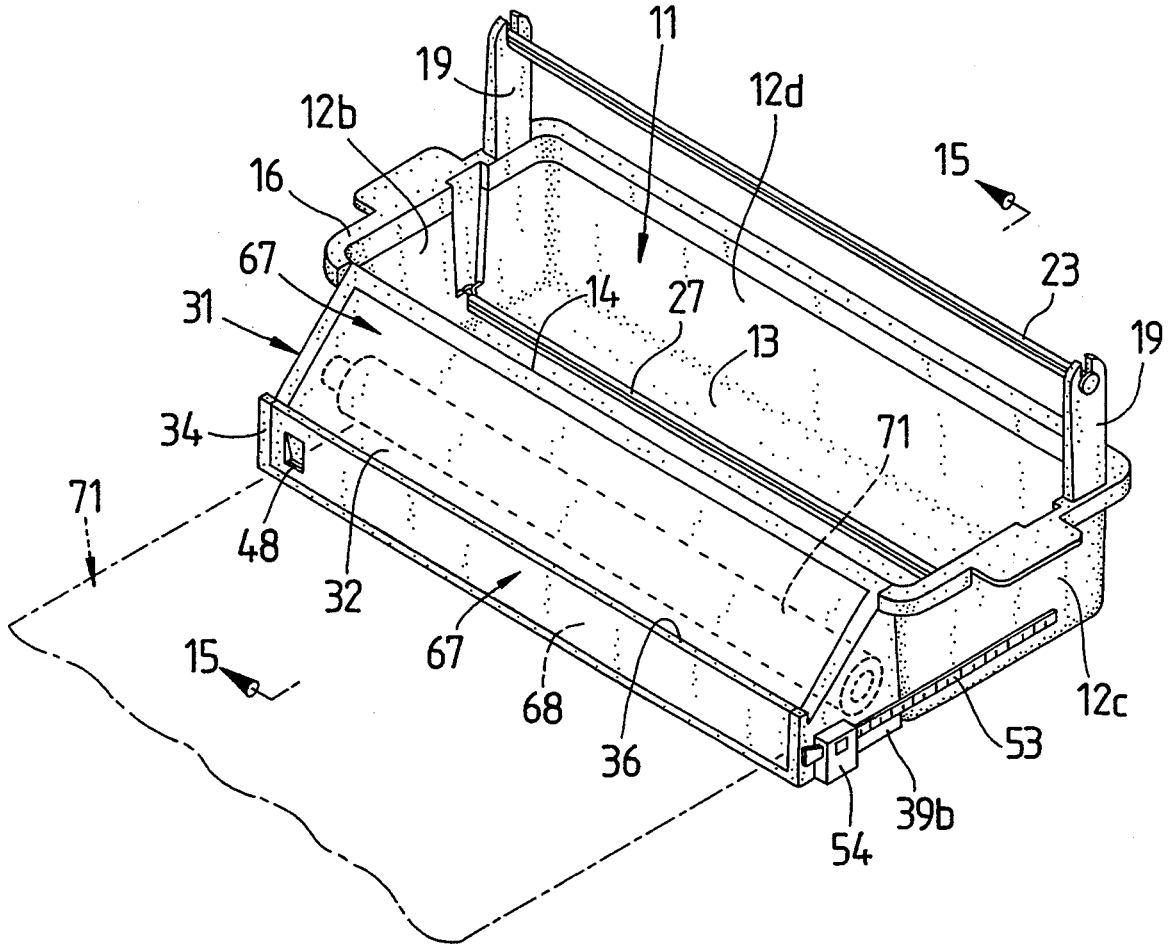
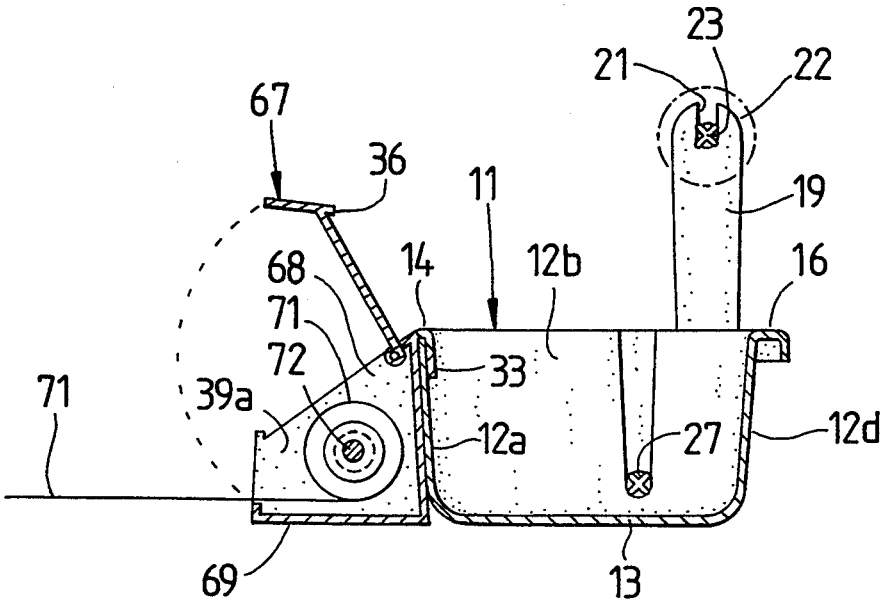
FIG. 15

APPARATUS FOR PREPARING WALLPAPER FOR APPLICATION

FIELD OF THE INVENTION

The present invention relates to wallpaper application tools. More particularly, the present invention relates to apparatus that moisten a layer of glue, pre-applied to one side of the wallpaper, as the wallpaper is dispensed.

BACKGROUND OF THE INVENTION

The task of wallpapering partially entails measuring the height of a wall where a strip of wallpaper is to be applied, rolling out a strip of wallpaper having a film of glue pre-applied to one side thereof, and measuring and cutting a strip of paper substantially equal to the measured height of the wall. The paper is cut at the measured length with special attention to cutting the paper evenly and perpendicularly to its length as the cut will form the upper margin of a subsequent strip- Water is applied to the film of glue using a brush or other hand-held tool and the strip is applied to the wall. Thereafter, the steps are repeated to apply subsequent strips in laterally adjacent relation to the first strip. If the wallpaper is patterned then special care must be taken to align the patterns of a subsequent strip with those on the preceding strip applied to the wall. It is very difficult to correctly measure a strip and have the patterns thereon align with the patterns on the preceding strip. Commonly, the subsequent strips are cut extra long, the patterns are aligned manually after the strip is applied to the wall and the extra wallpaper at the top and bottom of the strip is cut therefrom. This procedure is very clumsy, particularly messy and susceptible to human error when aligning the patterns.

Apparatus for automatically wetting a pre-applied film of glue are known in the industry. An example of such apparatus is shown in U.S. Pat. No. 4,300,471 issued to Desjardin which discloses a reservoir having water contained therein for hydrating a film of glue pre-applied to a sheet of wallpaper. Rollers are provided to guide the wallpaper within the contained water. No apparatus is disclosed in Desjardin for measuring the wallpaper or for cutting the wallpaper. Further, no apparatus is provided to facilitate the alignment of the patterns of one strip of paper with those on a laterally adjacent other strip.

U.S. Pat. No. 4,377,983 issued to Skarsten discloses a reservoir containing paste and having a roller therein immersed within the paste. Wallpaper is fed across the roller which applies a quantity of paste thereto. A "cutting template" is connected to the reservoir and extends forwardly thereof and may be pivoted to press a lower margin thereof against the paper and the surface to which the paper is applied. The paper is cut by drawing a cutting member along the lower margin of the template and against the surface to which the paper is applied. The cutting template may provide a cutting guide but appears to compel the user to cut into a visible part of the wall. No apparatus for measuring the wallpaper or for facilitating the alignment of the patterns on laterally adjacent sheets is provided.

SUMMARY OF THE INVENTION

The principal object of the present invention is to provide a wallpaper dispenser that automatically hydrates a film of glue pre-applied to one side of the wallpaper.

Another object of the present invention is to provide a wallpaper dispenser that simplifies the procedure of measuring and cutting wallpaper into strips.

Yet another object of the present invention is to provide a wallpaper dispenser that automatically aligns the patterns of two strips of wallpaper when the strips are positioned in laterally adjacent relation and with a lower margin of each extending along a common line.

These and other objects and advantages of the present invention are accomplished through the use of a rectangular reservoir having a pair of vertical members connected thereto on opposite sides thereof. The vertical members extend upwardly and support a first shaft carrying a roll of wallpaper thereon. The wallpaper is fed beneath a second shaft rotatably connected to the reservoir beneath the level of a quantity of water contained therein, preferably near a bottom thereof. The wallpaper is pulled over a forward lip of the reservoir and down a sloping front panel. The sloping panel has a ridge formed along a forward edge thereof in parallel relation to the roll of wallpaper and the forward lip of the reservoir. The ridge is provided to guide a cutting member in a straight line perpendicular to the length of the wallpaper to cut the wallpaper transversely and into strips. The water contained in the reservoir wets the pre-applied film of glue as the wallpaper is pulled therethrough. The wet wallpaper clings to the sloping panel which secures the wallpaper after cutting to prevent the newly cut forward edge of the wallpaper from sliding into the reservoir. The ridge provides a stable cutting edge and reference from which the length of the strip to be cut may be measured.

A tape measure is clipped to an end piece adjacent the sloping panel for indicating a point, at a selected distance from the ridge, adjacent which the forward edge of a strip of wallpaper to be cut should be positioned. The tape measure is extended forwardly until the desired measurement appears below the ridge. Alternatively a recess is provided in a vertical support panel supporting the sloping panel. The vertical support panel forms a lip subjacent the recess such that a member connected to an end of a tape measure in perpendicular relation thereto may be received within the recess and behind the lip. The tape measure is deployed forwardly of the ridge to indicate the selected point adjacent which the wallpaper is pulled, whereafter the paper is cut by drawing a cutting member along the ridge. An elongated member is slidably connected to an end piece supporting the sloping surface and is extendible forwardly of the ridge to facilitate the accurate matching of the patterns on a first strip with the patterns of a subsequently cut strip placed adjacent thereto.

BRIEF DESCRIPTION OF THE DRAWINGS

Apparatus embodying features of my invention are depicted in the accompanying drawings which form a portion of this disclosure and wherein:

FIG. 14 is a perspective view of a fourth embodiment of the present invention; and FIG. 15 is a sectional view taken along line 15—15 of FIG. 14.

DESCRIPTION OF A PREFERRED EMBODIMENT

Figure 1:
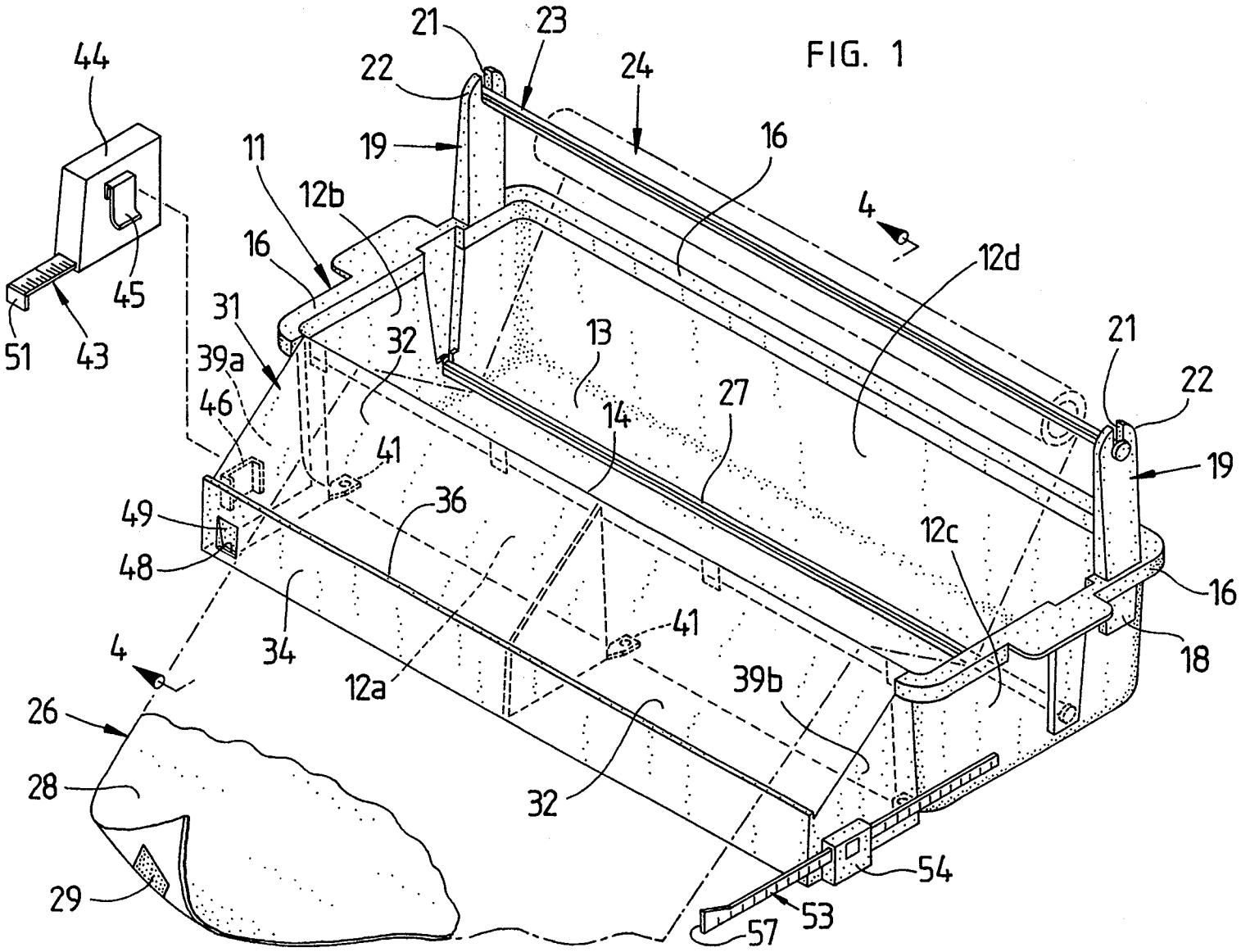
FIG. 1 is a perspective view of a first embodiment of the present invention.
Figure 2:
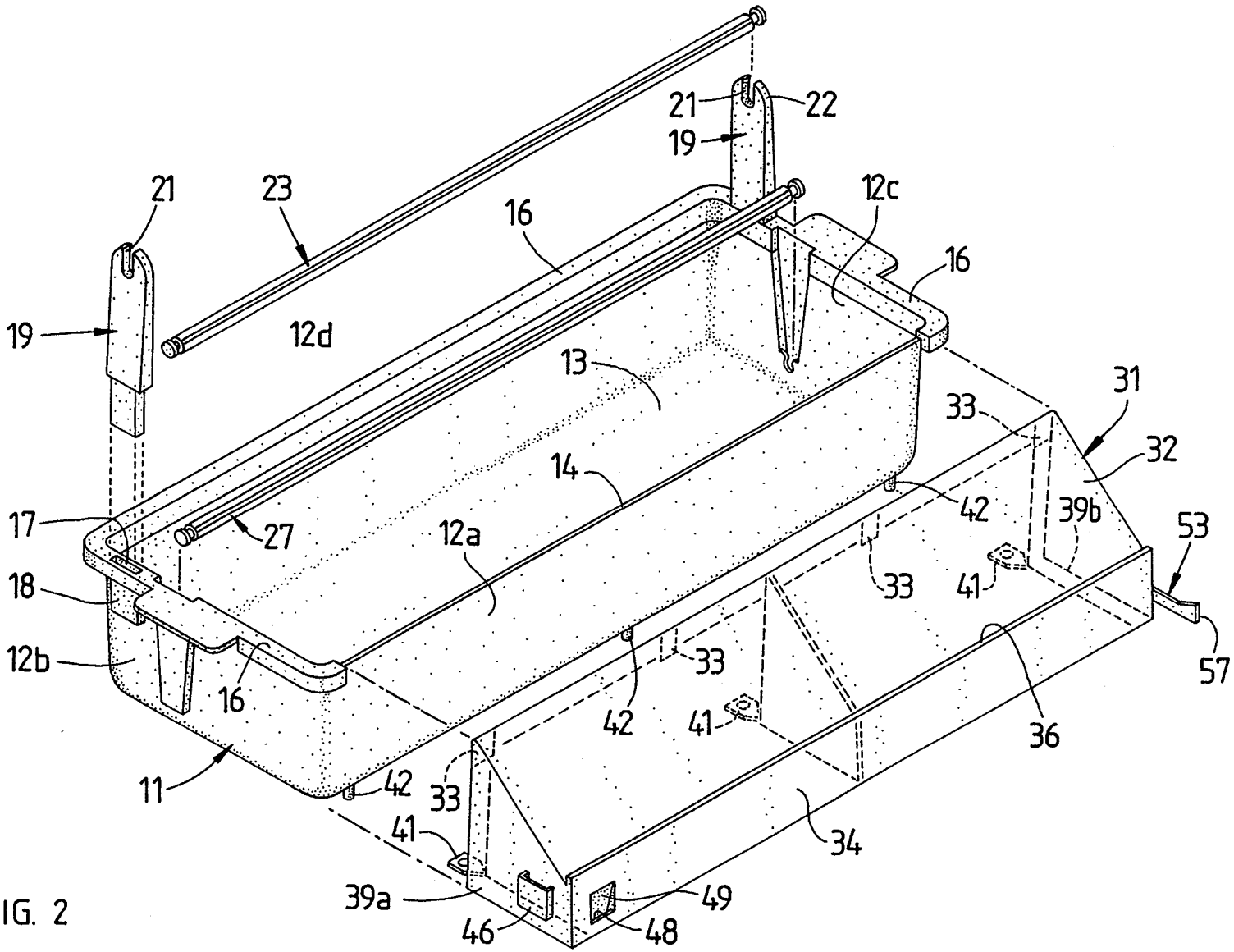
FIG. 2 is an exploded perspective view of the first embodiment of the present invention.
Figure 3:
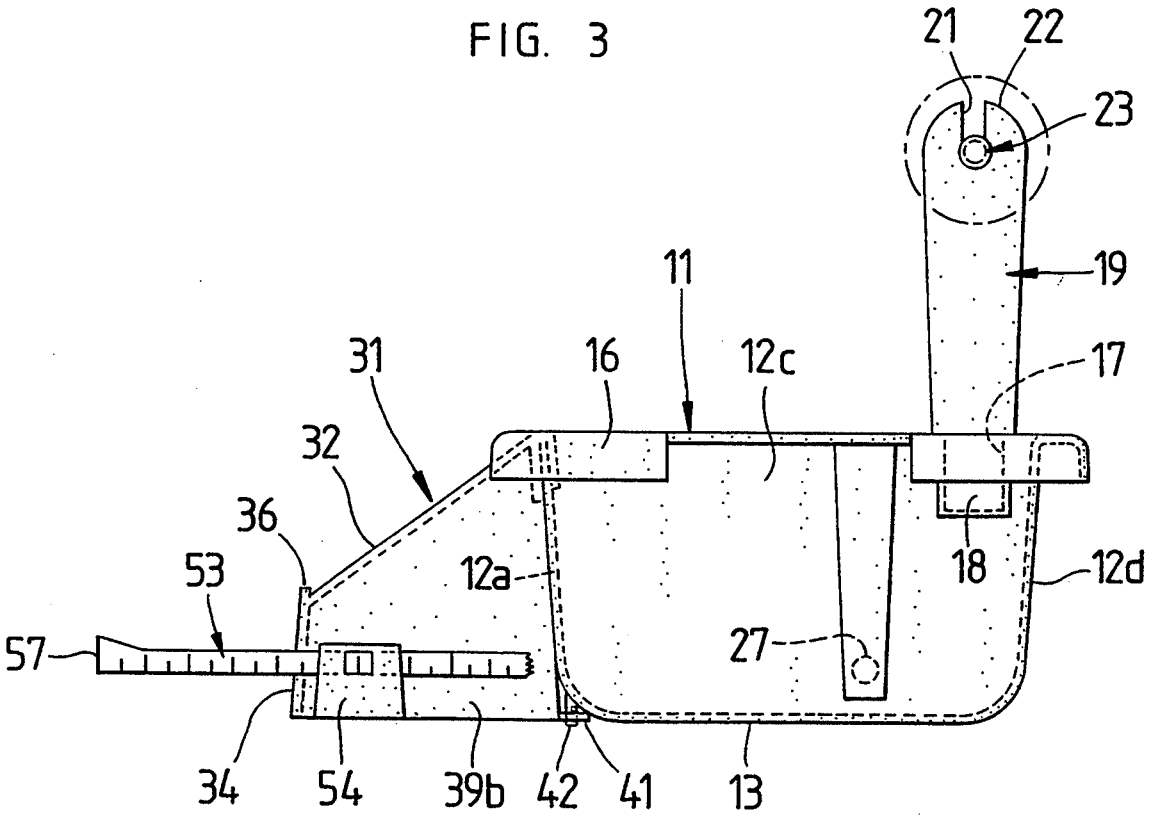
FIG. 3 is a side elevational view of the first embodiment of the present invention.
Figure 4:
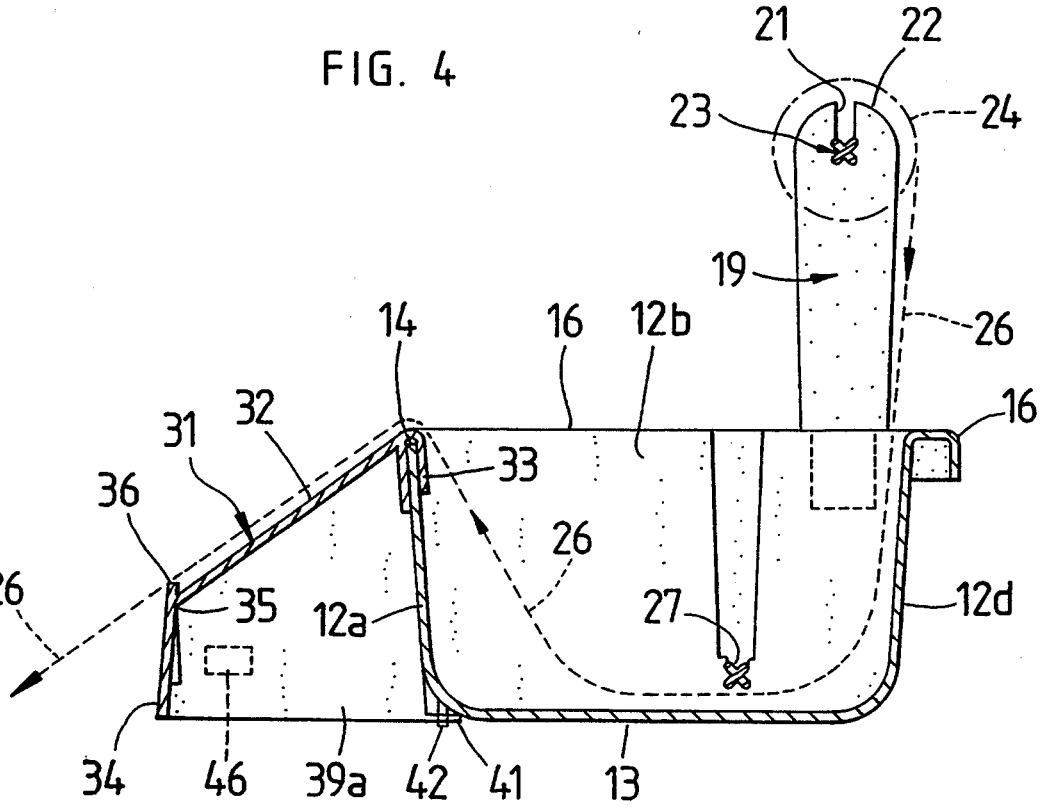
FIG. 4 is a sectional view taken along line 4—4 of FIG. 1.
Figure 5:
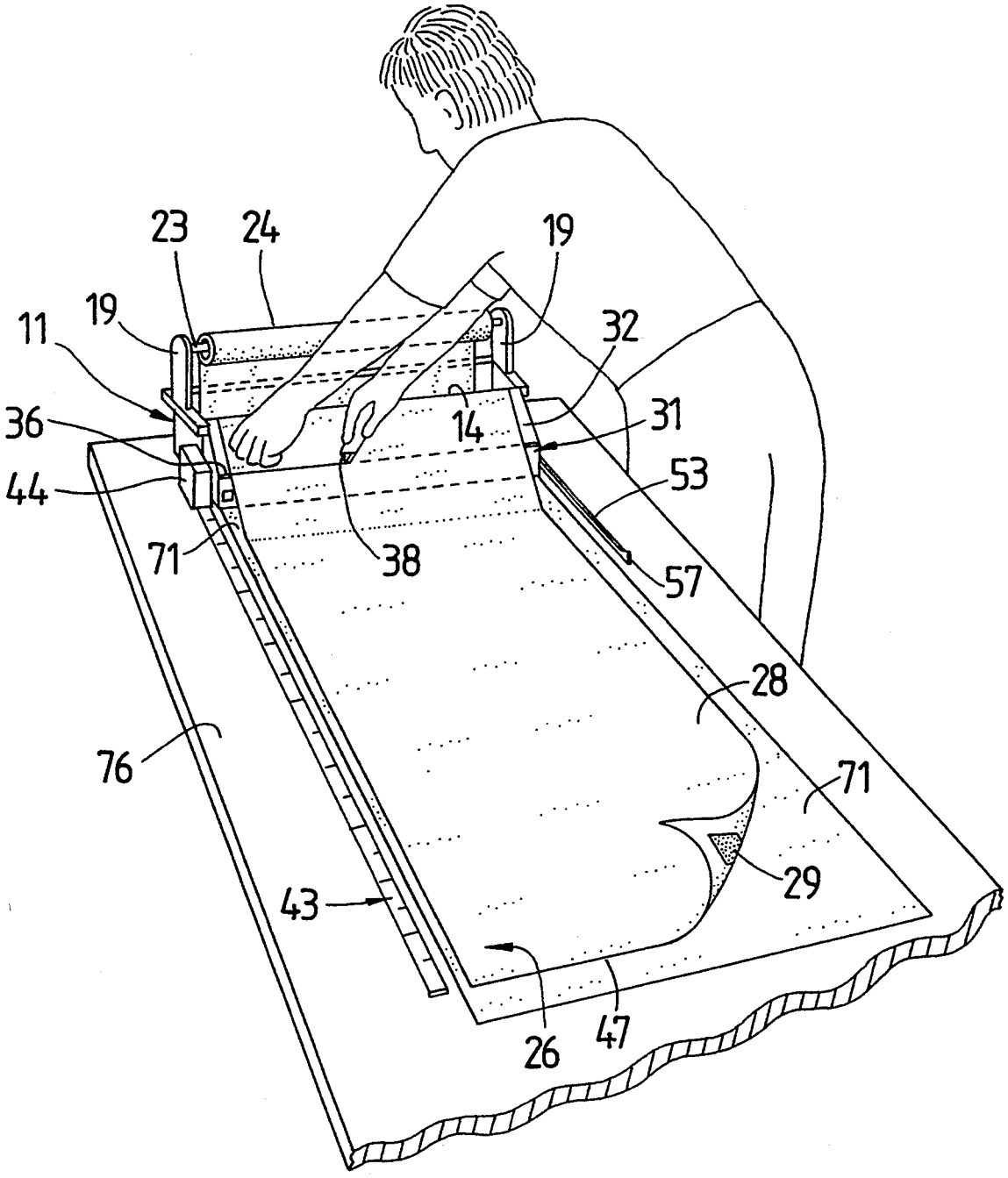
FIG. 5 is a perspective view of the present invention being used to measure and cut wallpaper.
Figure 6:
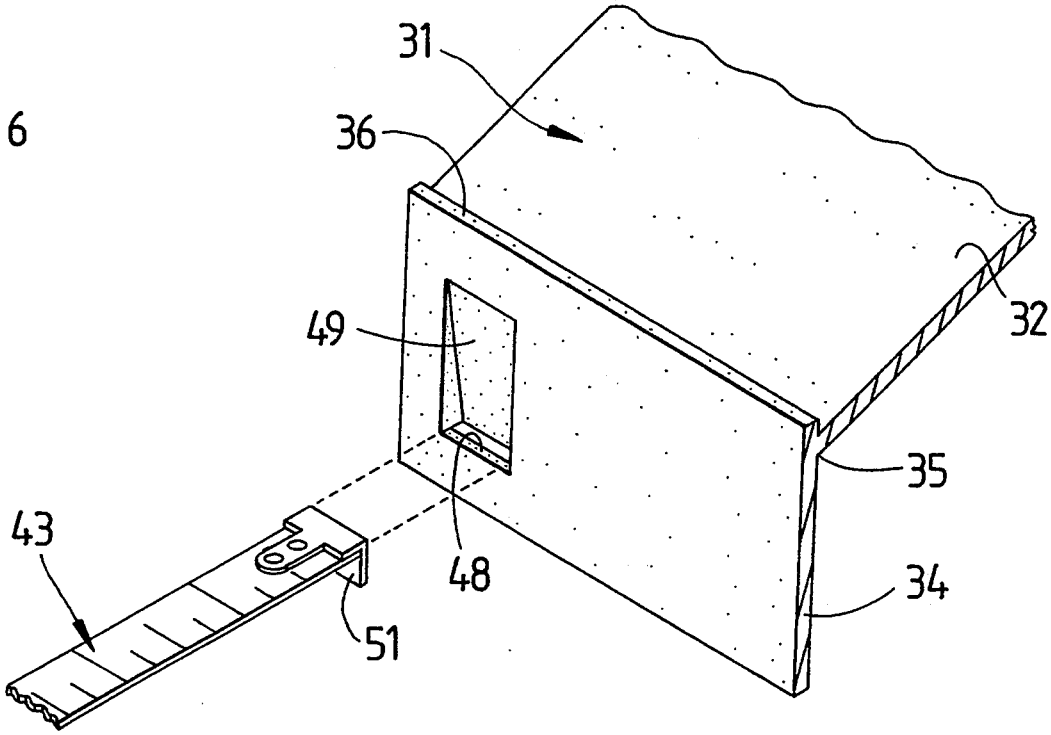
FIG. 6 is a detailed perspective view of a tape measure and a receiving recess as defined by the present invention.
Figure 7:
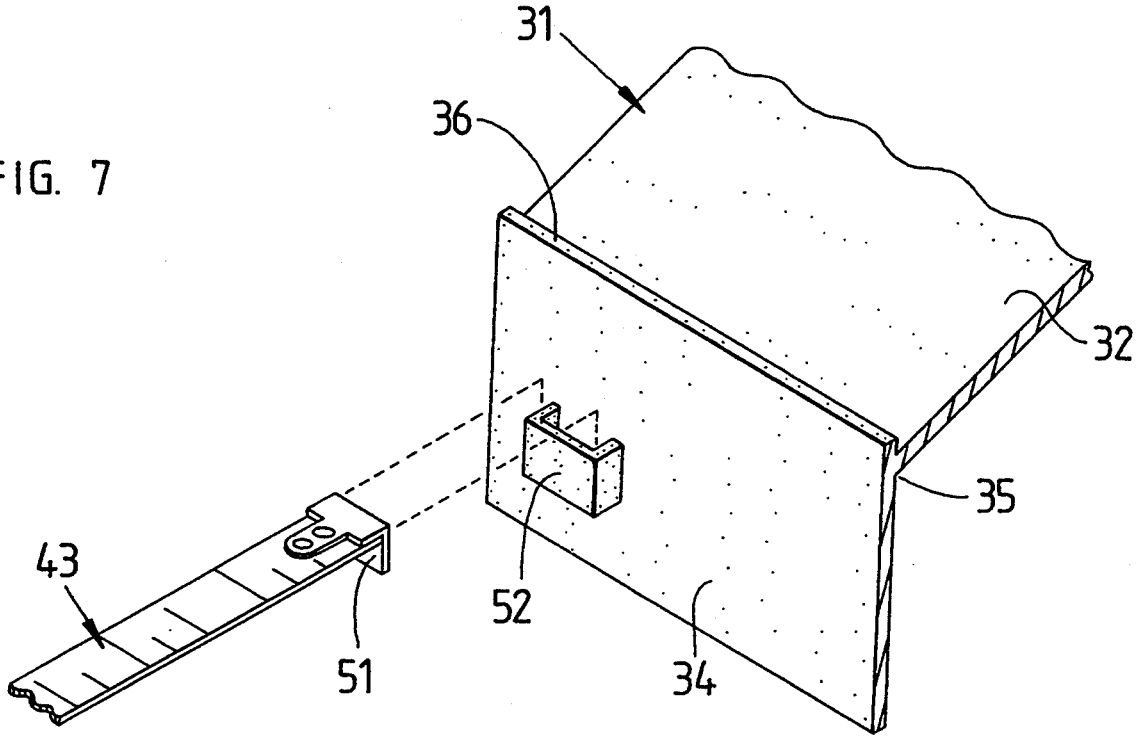
FIG. 7 is a detailed perspective view of a tape measure and a receiving C-shaped mount as defined by the present invention.

Referring to the drawings for a clearer understanding of the invention, it should be noted in FIGS. 1 and 2 that the present invention contemplates the use of a reservoir 11 having four substantially vertical sides 12*a*–12*d* and a bottom 13. Side 12*a* has an upper margin that defines a forward lip 14 of the reservoir 11. The remaining sides 12*b*–12*d* have a rim 16 coextending the upper margin of each and extending outwardly from the reservoir 11. As shown in FIG. 2, a pair of apertures 17 extend through the rim 16 adjacent sides 12*b* and 12*c* and communicate with a pair of pockets 18 integrally connected to sides 12*b* and 12*c* and to the rim 16. A pair of vertical members 19 are received through apertures 17 and within pockets 18 and extend upwardly therefrom having notches 21 defined by upper ends 22 thereof. A support roller 23 is received within notches 21 and supported by the vertical members 19 in parallel relation to the forward lip 14 for rotary movement about a horizontal axis. A roll 24 of wallpaper 26 is supported by support roller 23 for rotary movement thereon. The wallpaper 26 is fed downwardly from the roll 26 and beneath a guide roller 27 rotatably connected to the reservoir 11. The wallpaper 26 has a film 28 of glue pre-applied to one side thereof and may have a repeating pattern or design 29 printed on a side thereof opposite the film 28. A quantity of water (not shown) is contained in the reservoir 11 and hydrates the film 28 of glue as the wallpaper 26 is fed beneath the guide roller 27. A ramp 31 is detachably connected to the reservoir 11 adjacent the forward lip 14 and, as shown in FIGS. 1–4, includes a sloping panel 32 having tabs 33 integrally connected thereto that extend over the forward lip 14 to secure the sloping panel 32 thereto. A substantially vertical support panel 34 is integrally connected to a forward edge of the sloping panel 32 which slopes downwardly and forwardly from the forward lip 14. The support panel 34 supports the sloping panel 32 and forms a horizontal corner 35 extending parallel to the forward lip 14 and rods 23 and 27. A ridge 36 is formed on the sloping panel 32 and coextends the corner 35. As shown in FIG. 5, the wallpaper 26 is pulled from the reservoir 11 over the forward lip 14, down the sloping panel 32 and forwardly of the ridge 36. A first strip 37 of wallpaper 26 is cut by drawing a cutting member 38 along ridge 36. The wet wallpaper 26 adheres to the sloping panel 32 and prevents a newly cut edge of the remaining wallpaper 26 from slipping into the reservoir. End members 39*a* and 39*b* are integrally connected to the sloping panel 32 and vertical support panel 34 for additional support. Members 41 are connected to the vertical support panel 34 and extend rearwardly therefrom to engage pins 42, which are connected to reservoir 11, and thereby secure the ramp 31 thereto. An extendible tape measure 43, wound within a housing 44 is detachably connected to end member 39*a* by inserting a clip 45 connected to the housing 44 through a C-shaped mount 46 integrally connected to end member 39*a*. The tape measure 43 is extended forwardly of the ridge 36, as shown in FIG. 5, to indicate a point adjacent which a forward margin 47 of the wallpaper 26 should be positioned such that the first strip 37 may be cut a selected length. An alternative apparatus for facilitating accurate measurement includes a recess 48 defined by the vertical support panel 34 which forms a lip 49 subjacent the recess 48. As shown in FIG. 6, a member 51 connected to an end of the tape measure 43, in perpendicular relation thereto, is received within the recess 48 behind the lip 49 such that the tape measure 43 may be deployed forwardly of the ridge 36 to indicate a selected distance therefrom. It should be readily apparent that various structures for receiving the member 51 adjacent the ridge 36 are contemplated. FIG. 7 shows the use of a C-shaped mount 52 integrally connected to the vertical support panel 34 for receiving the member 51 intermediate the C-shaped mount and the support panel 34.

An elongated member 53 is slidably connected to end member 39*b* by mount 54 and is slidably extendible forwardly of said ridge 36. The elongated member 53 is used to automatically align the patterns 29 on two or more strips of wallpaper 26 applied to a planar surface in laterally adjacent relation and with a top margin of each coextending a common line.

Figure 11:
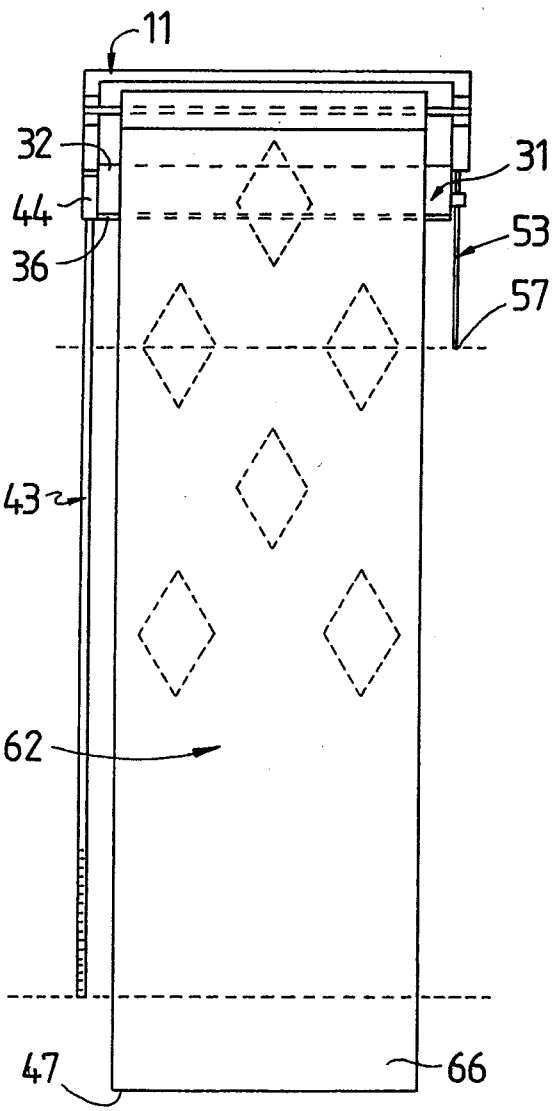
FIG. 11 is a plan view of the present invention with the subsequent strip of wallpaper pulled forwardly to a cutting position.
Figure 10:
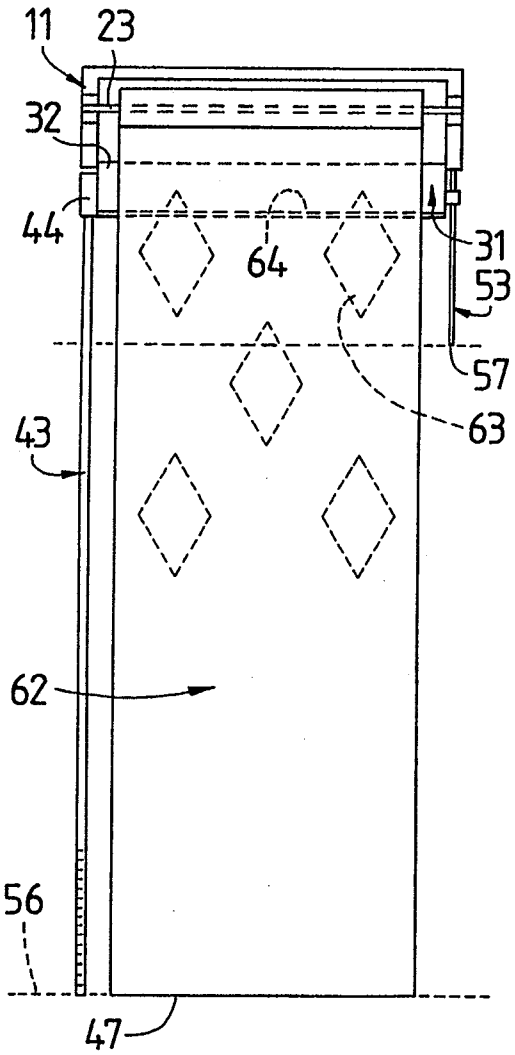
FIG. 10 is a plan view of the present invention with a subsequent strip of wallpaper disposed forwardly thereof to a premeasured position.
Figure 8:
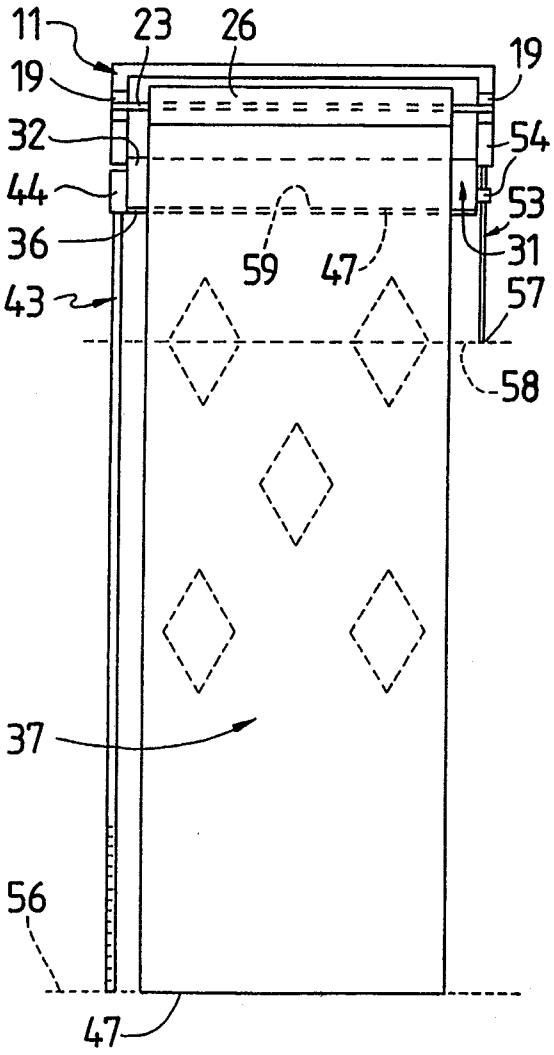
FIG. 8 is a plan view of the present invention with a first strip of wallpaper disposed forwardly thereof to a cutting position.
Figure 9:
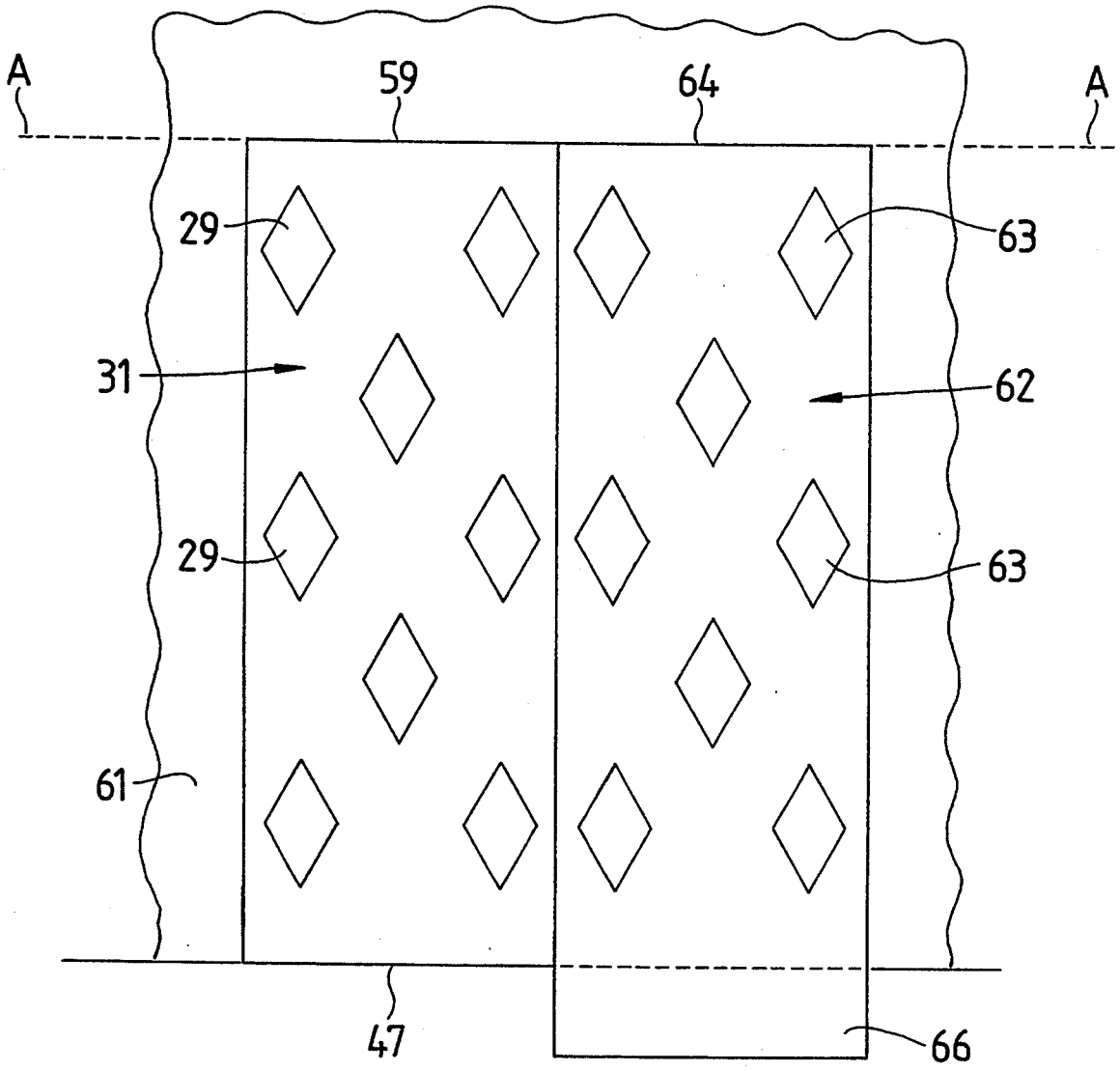
FIG. 9 is a side elevational view of the first and subsequent strips of wallpaper applied to a planar wall.

In operation and as shown in FIG. 8, a selected distance equal to the length of the first strip 37 is indicated with the measuring tape 43 as previously described. The forward margin 47 is positioned adjacent to a point 56 designated at the selected distance. The elongated member 53 is extended forwardly of the ridge 36 until a forward tip 57 of the elongated member 53 is adjacent to a selected, easily identified point 58 on the pattern spaced just forwardly of the ridge 36. For purposes of example the pattern is shown in FIGS. 8–11 to be a series of "diamonds". The selected point 58 is the point where the "diamond" is closest to a lateral margin of the wallpaper 26. When the forward tip 57 is positioned adjacent the selected point 58, the cutting member 38 is drawn along the ridge 36 to cut the first strip 37. The cut defines a top margin 59 of the first strip 37 and redefines the forward margin 47 of the remaining wallpaper 26. The first strip 37 is applied to a wall 61 as shown in FIG. 9 with the top margin 59 of the first strip coextending a predetermined line (indicated in FIG. 9 as A). As shown in FIG. 10, a subsequent strip 62 is prepared by pulling the forward margin 47 adjacent the designated point 56 which may or may not be the same as that selected for the first strip 37. The subsequent strip 62 is then urged forwardly, as shown in FIG. 11, until the selected point 54 on an adjacent pattern 63 is adjacent the forward tip 57. The cutting member 38 is drawn along the ridge 36 to cut the subsequent strip 62 and define a top margin 64 thereof. The subsequent strip 62 is applied to the wall 61 in laterally adjacent relation to the first strip 37 with the top margin 64 aligned with line A and top margin 59. An extra portion 66 of wallpaper will extend downwardly past the first strip 37 and may be trimmed with cutting member 38 to align the bottom margins of the strips as required. When the subsequent strip 62 is applied as described, the patterns on the first and subsequent strips will automatically be aligned- It should be noted that any member having an indication point thereon that is movable forwardly of ridge 36 may be used as a positioning reference for point 54. Such reference indicators include but are not limited to an extendible tape measure or telescoping member (not shown) which can be fixed relative to the ridge.

Figure 12:
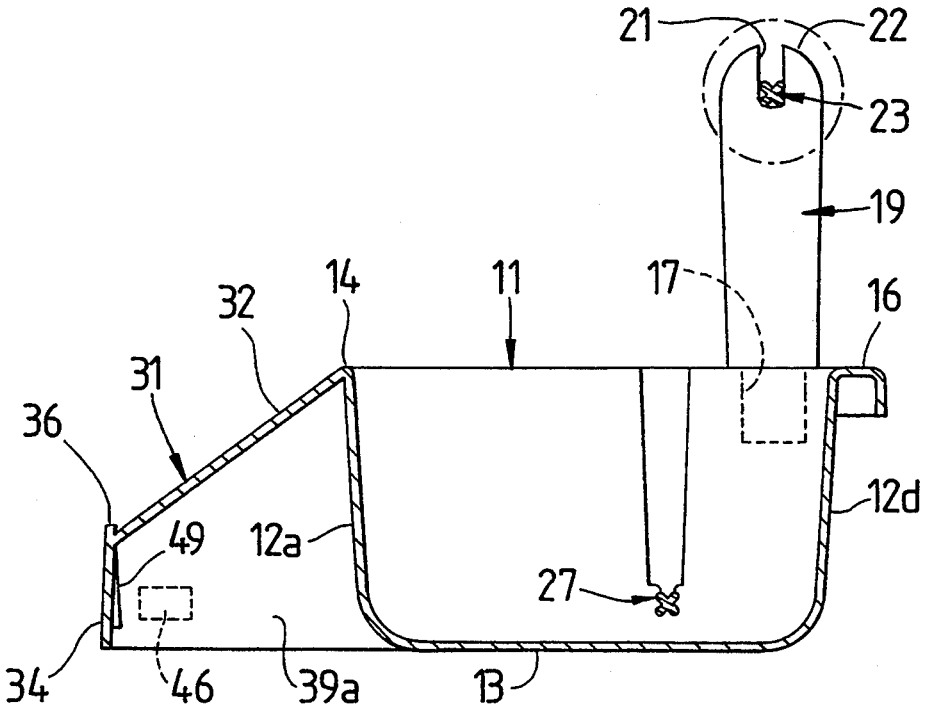
FIG. 12 is a sectional side elevational view of a second embodiment of the present invention.

A second embodiment of the present invention is shown in FIG. 12 which shows the ramp 31 and reservoir 11 integrally connected. End members 39*a* and 39*b* are integrally connected to the reservoir 11 and connectors 41 and pins 42 have been eliminated.

Figure 13:
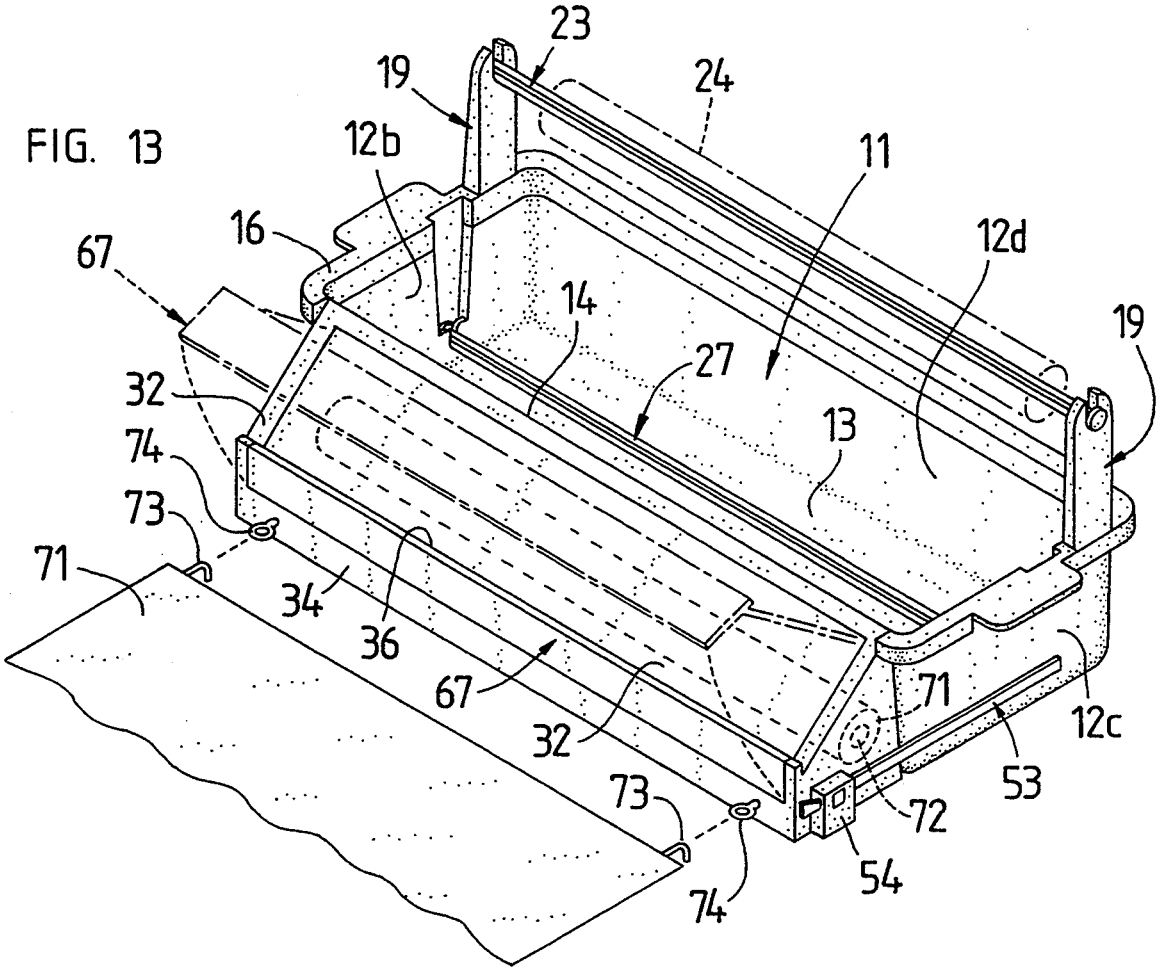
FIG. 13 is a perspective view of a third embodiment of the present invention.

A third embodiment of the present invention is shown in FIG. 13 and includes a door 67 pivotally connected to the sloping panel 32 for movement about a horizontal axis. The door 67 forms a portion of the sloping panel 32, ridge 36 and vertical support panel 34 and is used to access an enclosed storage chamber 68 defined by the sloping panel 32, vertical support panel 34, end panels 39*a* and 39*b*, side 12*a* of reservoir 11 and a bottom 69 integrally connected to the end panels 39*a* and 39*b* and to the vertical support panel 34. The storage container is useful for holding any wallpapering tools (not shown) that will fit therein but is particularly structured to contain a drop cloth 71 rolled about a shaft 72. The drop cloth 71 has a plurality of hooks 73 thereon that operatively engage a plurality of eyes 74 connected to the vertical support panel 34 such that the drop cloth 71 may be rolled forwardly thereof while remaining adjacent thereto. As shown in FIG. 5, the drop cloth 71 isolates the wet wallpaper 26 from a surface 76 on which the present invention and wallpaper 26 are supported thus preventing water and hydrated glue from contacting surface 76.

A fourth embodiment of the present invention is shown in FIGS. 14 and 15 and includes the door 67 and storage chamber 68. The shaft 72 is rotatably mounted within the storage chamber 68 and to end panels 39*a* and 39*b* for rotation about a horizontal axis. The drop cloth 71 is positioned forwardly of the ramp 31 by opening the door 67, pulling the drop cloth 71 forwardly and shutting the door 67 thereon. After use, the soiled portion of the drop cloth 71 may be cut from the remainder. If a non-disposable drop cloth 71 is used it may be cleaned then rolled within the storage chamber 64. Spring actuated apparatus (not shown) for rotating the shaft 72 are well known and may be connected to the shaft 72 and end panels 39 for rolling the drop cloth 71 about shaft 72. From the foregoing, it should be clear that the present apparatus represents a substantial improvement over the prior art.

While I have shown my invention in several forms, it will be obvious to those skilled in the art that it is not so limited but is susceptible of various changes and modifications without departing from the spirit thereof.

What I claim is:

1. Apparatus for dispensing a roll of wallpaper having glue pre-applied to one side thereof and a repeating pattern on the other side thereof, said dispenser comprising:

(a) a reservoir having a quantity of water therein for wetting said glue;

(b) guide means connected to said reservoir for guiding said wallpaper within said water and across a forward lip of said reservoir;

(c) means connected to said reservoir for indicating a point at a selected distance from said reservoir, wherein a forward margin of said wallpaper may be positioned adjacent to said point such that said wallpaper may be cut adjacent said reservoir a selected length substantially equal to said selected distance; and (d) a cutting ramp connected to said reservoir adjacent said forward lip and sloping downwardly therefrom, wherein said ramp has a sloping cutting panel with two end panels integrally connected to said sloping panel and a vertical support panel in substantially normal relation thereto and extending adjacent to said reservoir, and said vertical support panel connected to said sloping panel and forming a ridge thereon along which a cutting member is drawn to cut said wallpaper said predetermined length and a bottom integrally connected to a lower edge of said vertical support panel and said end panels, such that said reservoir, sloping panel, vertical support panel and end panels form an enclosed storage chamber, and door means pivotally connected to said sloping panel and forming a portion thereof and of said vertical support panel for accessing said storage chamber.

2. Apparatus as defined in claim 1 further comprising a drop cloth wrapped about a shaft and enclosed within said enclosure, wherein said shaft is rotatably connected to said end panels for rotary movement about a horizontal axis such that said drop cloth may be manually pulled from said storage chamber and forwardly of said ramp.

3. Apparatus as described in claim 1 further comprising:

(a) a drop cloth wrapped about a shaft and enclosed within said enclosure, said drop cloth having a plurality of first connectors attached thereto; and (b) a plurality of second connectors connected to said vertical support and corresponding to said first connectors wherein said first connectors may be detachably connected to said second connectors such that said drop cloth is rolled forwardly of said ramp to isolate said wallpaper from a supporting surface thereunder.

4. Apparatus for dispensing a roll of wallpaper having glue pre-applied to one side thereof and a repeating pattern on the other side thereof, said dispenser comprising:

(a) a reservoir having a quantity of water therein for wetting said glue;

(b) guide means connected to said reservoir for guiding said wallpaper within said water and across a forward lip of said reservoir;

(c) means connected to said reservoir for indicating a point at a selected distance from said reservoir, wherein a forward margin of said wallpaper may be positioned adjacent to said point such that said wallpaper may be cut adjacent said reservoir a selected length substantially equal to said selected distance;

(d) a cutting ramp connected to said reservoir adjacent said forward lip and sloping downwardly therefrom, wherein said ramp has a sloping cutting panel and a substantially vertical support panel connected to said sloping panel and forming a ridge thereon along which a cutting member is drawn to cut said wallpaper said predetermined length;

(e) means, connected to said reservoir and selectively positionable adjacent a point on said repeating pattern when said forward margin is positioned adjacent said point defined by said indicating means, for defining a pattern alignment reference relative to said ridge; and wherein said defining alignment means comprises an elongated member mounted to said reservoir and said ramp means for movement forwardly of said ridge, wherein a forward tip of said elongated member is aligned with a selected point on a said repeating pattern of said first strip when a forward margin of said first strip is pulled said measured distance from said slot, such that said subsequent strips are cut by pulling said subsequent strips forwardly until said selected point on an said repeating pattern is aligned with said forward tip, whereafter said cutting member is drawn along said ridge to cut said subsequent strip from said roll.

5. Apparatus for dispensing a roll of wallpaper having glue pre-applied to one side thereof, a repeating pattern on an opposite side thereof and a forward margin parallel to said roll, said apparatus comprising:

(a) a reservoir having a quantity of water contained therein for hydrating said pre-applied glue;

(b) a pair of vertical members detachably connected to said reservoir and extending upwardly therefrom;

(c) a support roller rotatably connected to said pair of vertical members and supported thereby above said reservoir for rotary movement about a horizontal axis, wherein said support roller extends axially through said roll of wallpaper and supports and roll above said reservoir;

(d) a guide roller rotatably connected to said reservoir and within said quantity of water contained therein for guiding said wallpaper beneath said water, wherein said wallpaper is manually fed beneath said guide roller and over a forward lip of said reservoir parallel to said guide roller;

(e) a ramp sloping forwardly and downwardly from said forward lip and defining a ridge thereon parallel to said forward lip, wherein said wallpaper is pulled across said ridge such that a cutting member drawn along said ridge will cut said wallpaper parallel to said forward margin thereof; and (f) means for automatically aligning a repeating pattern on a roll of wallpaper comprising a means for measuring attached to said reservoir to measure a predetermined length of said wallpaper and an elongated member adjustably attached to said reservoir such that said elongated member is selectively set to define a reference position to align subsequent cut length of wallpaper thereto.

6. Apparatus as defined in claim 5 further comprising a recess formed on said ramp and partially defined by a lip portion thereof defined by said ramp below said ridge and subjacent said recess wherein a member, connected to an end of a tape measure in perpendicular relation thereto, is received within said recess and behind said lip such that said tape measure may be deployed forwardly of said ramp to indicate a point a selected distance from said ridge.

7. Apparatus for dispensing a roll of wallpaper having a repeating pattern on one side thereof and a forward margin parallel to said roll, said apparatus comprising:

(a) a reservoir having a bottom and four substantially vertical sides for containing a quantity of fluid;

(b) a means for supporting said roll of wallpaper above said reservoir;

(c) a guide roller rotatably connected to said reservoir and within said quantity of fluid contained therein for guiding said wallpaper beneath said fluid, wherein said wallpaper is urged beneath said guide roller and over a forward lip of said reservoir parallel to said guide roller;

(d) a ramp sloping forwardly and downwardly from said forward lip and defining a ridge thereon parallel to said forward lip, wherein said wallpaper is pulled across said ridge such that a cutting member drawn along said ridge will cut said wallpaper parallel to said forward margin thereof;

(e) an elongated member slidably connected to said ramp and extendible forwardly therefrom to a selected position to define a reference for aligning said repeating pattern on a first strip of wallpaper, cut from said roll, with said repeating pattern on one or more subsequent strips of wallpaper, cut from said roll, when said first and subsequent strips are applied to a planar surface in laterally adjacent relation and with a top margin of said first and subsequent strips aligned; and (f) means operatively attached to said reservoir for measuring the length of a strip of wallpaper relative to said ridge.

8. Apparatus for dispensing a roll of wallpaper having a repeating pattern on one side thereof and a forward margin parallel to said roll, comprising a reservoir for containing a fluid for moistening said wallpaper to enable application thereof to a wall, support means for supporting said roll for rotational movement about the horizontal axis of said roll, guide means connected to said reservoir for guiding said wallpaper from said roll within said reservoir and fluid to ensure that said wallpaper is sufficiently moistened to adhere to the; cutting guide means for guiding a cutting member across said wallpaper at a fixed reference to sever said wallpaper into individual strips; means attached to said reservoir for measuring said wallpaper relative to said cutting guide to measure the length of said individual strips; and pattern aligning means adjustably mounted to said reservoir and selectively extendable for alignment with a point on said repeating pattern relative to said cutting guide to provide a pattern alignment reference for said individual strips.

* * * * *